United States Patent [19]

Veilleux

[11] 4,050,492

[45] Sept. 27, 1977

[54] SUPPORT FOR FLEXIBLE BAG

[76] Inventor: Florian Leo Veilleux, Old Bridge Lane, Danbury, Conn. 06810

[21] Appl. No.: 725,975

[22] Filed: Sept. 23, 1976

[51] Int. Cl.[2] ..... B65D 33/16

[52] U.S. Cl. ..... 150/4; 150/12; 248/99

[58] Field of Search ..... 150/1.7, 1.8, 4, 5, 150/12, 16, 17, 18; 248/99, 100, 101

[56] References Cited

U.S. PATENT DOCUMENTS

| | | | |
|---|---|---|---|
| 503,113 | 8/1893 | Osterloh | 150/4 |
| 605,343 | 6/1898 | Ross | 150/4 |

*Primary Examiner*—Donald F. Norton
*Attorney, Agent, or Firm*—Buckles and Bramblett

[57] ABSTRACT

A hinged ring for supporting the open top of a flexible bag. The ring is formed by two semicircular ring members hinged to be positioned between either of an open circular configuration and a folded configuration. A combination latch and handle member is mounted on one of the ring members and serves to latchingly engage the other ring member when folded, while also serving as a carrying handle. When the ring is open, the same latch member functions as a hook to support the ring and bag on an external surface.

4 Claims, 5 Drawing Figures

Fig. 3.
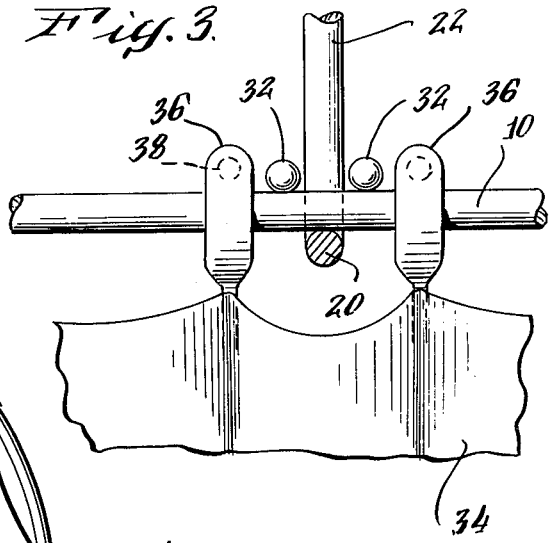
Fig. 1.
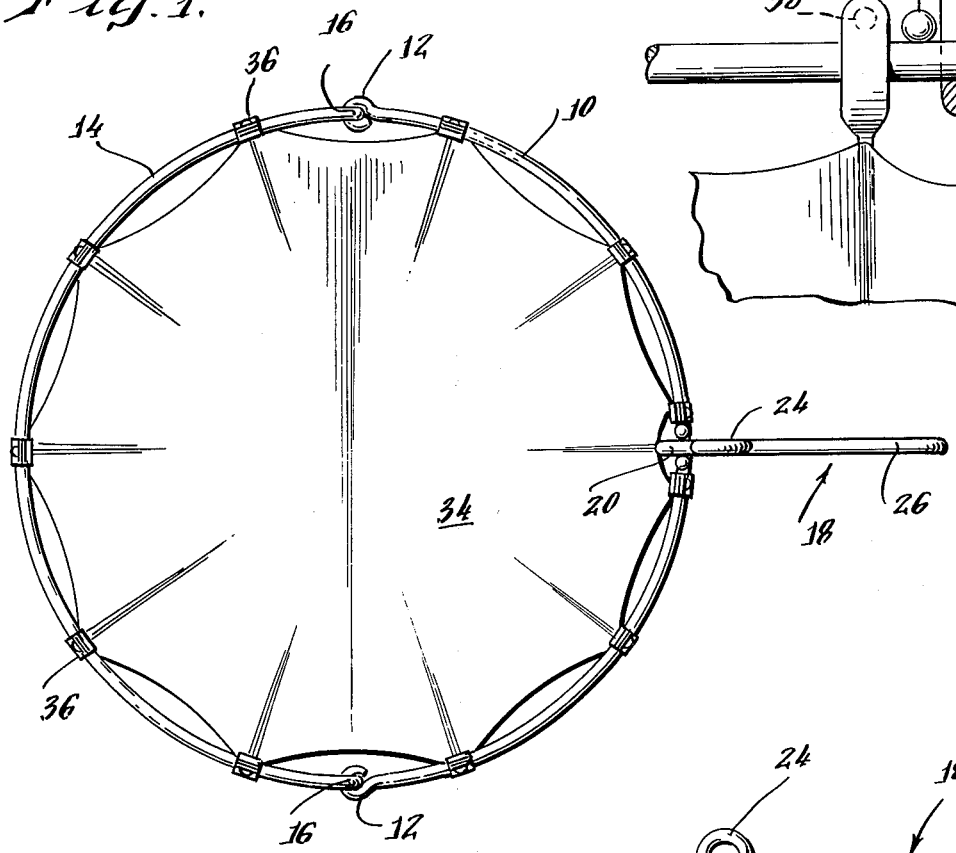
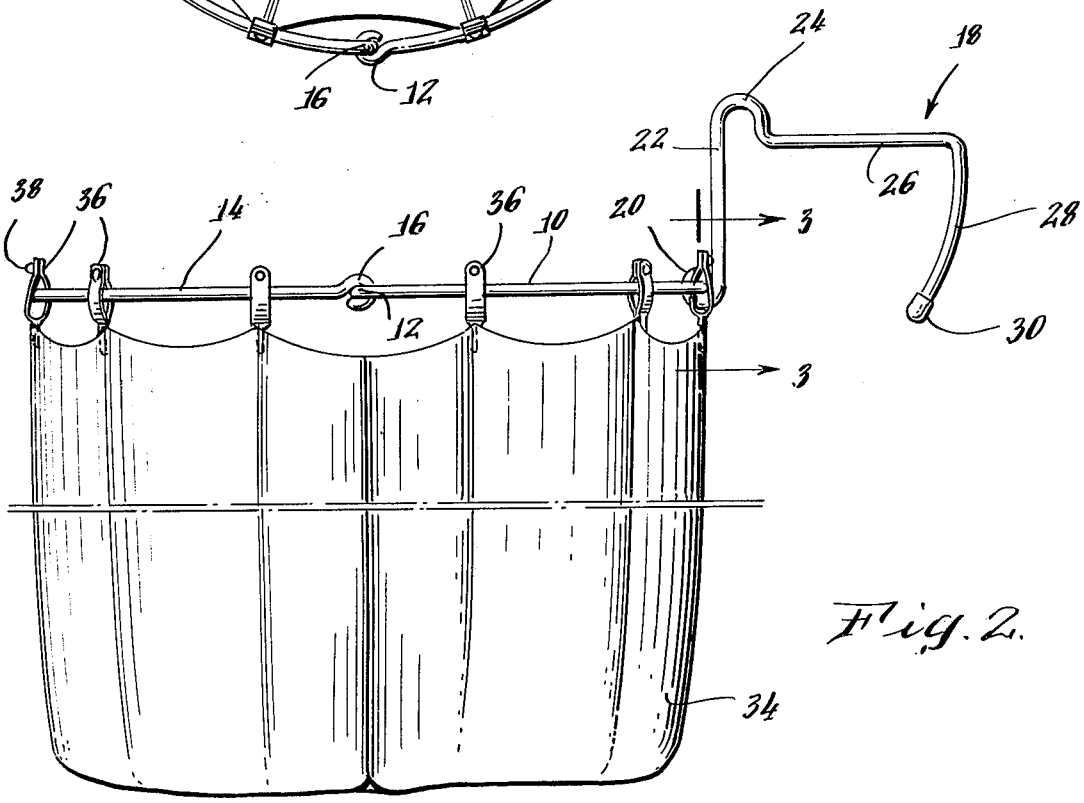
Fig. 2.

Fig. 4.
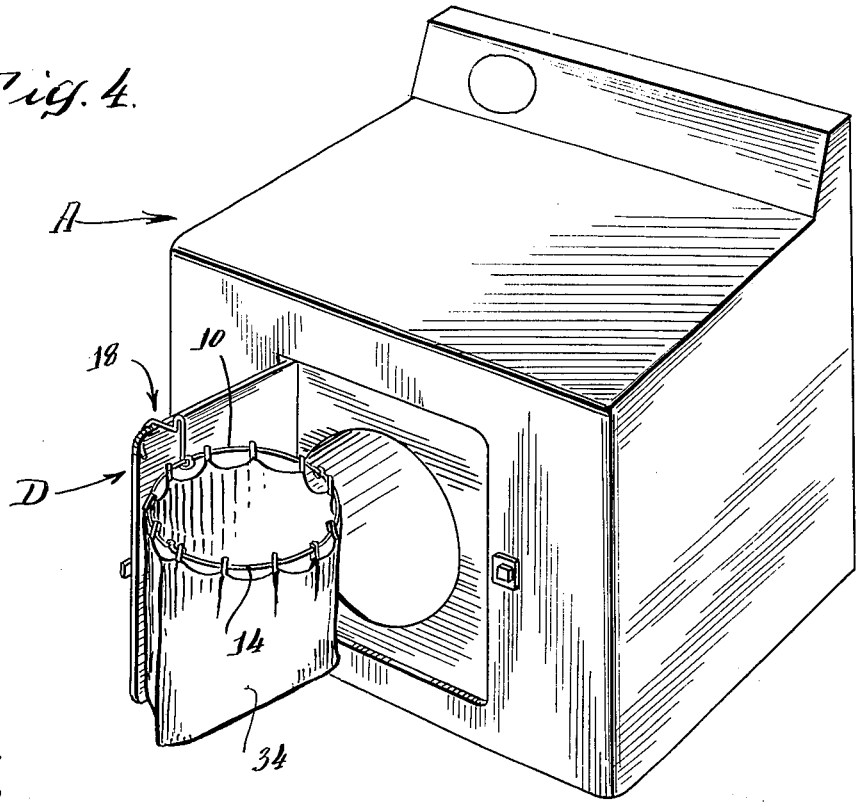
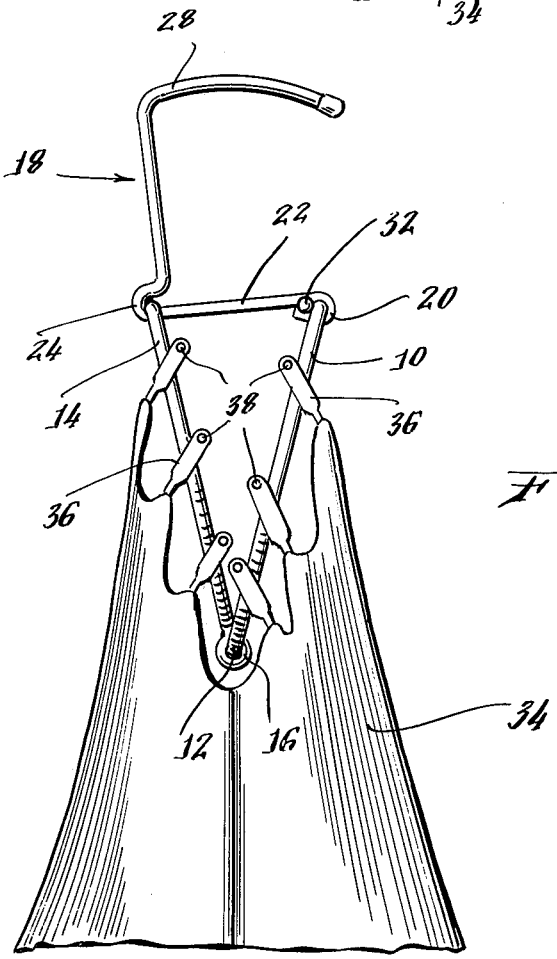
Fig. 5.

SUPPORT FOR FLEXIBLE BAG

BACKGROUND OF THE INVENTION

This invention pertains to a holder for a flexible bag and, more particularly, to a holder which is well adapted for use with laundry bags. Many persons not having home laundry appliances find it necessary to transport laundry between the home and a self-service laundry or between a washing machine at one location and a dryer at another. It is usually preferred to use a cloth or plastic bag for such a purpose. However, it is difficult to load laundry, especially wet laundry, into such a bag because the mouth of the bag does not remain in a conveniently open position and the limpness of the bag also makes it difficult to support. Accordingly, it is a primary object of the present invention to provide an apparatus which will selectively retain the top of a flexible bag in either an open or closed position. Other objects are to provide such an apparatus which will serve to support the bag while open; which will serve to hold the bag mouth closed; and which will serve as a convenient carrying handle for the bag. The manner in which these objects are achieved will be more apparent from the following description and appended claims.

SUMMARY OF THE INVENTION

A support member for a flexible bag comprising a pair of partial ring members hingedly interconnected so as to be movable from an open, closed ring, configuration to a collapsed, substantially side-by-side, configuration. Means are carried by one of the ring members for latchingly engaging the other ring member when in said collapsed configuration.

BRIEF DESCRIPTION OF THE DRAWINGS

FIG. 1 is a plan view of a support member and bag in accordance with the present invention, the support member being shown in its open configuration;

FIG. 2 is an elevational view of the member and bag of FIG. 1;

FIG. 3 is an enlarged cross section taken substantially along the line 3—3 of FIG. 2;

FIG. 4 is a perspective view illustrating the invention in use with a laundry appliance; and, FIG. 5 is an elevational view showing the apparatus of the invention in its closed and latched configuration.

DESCRIPTION OF THE PREFERRED EMBODIMENT

With particular reference to FIGS. 1 and 2, there is illustrated a bag support in accordance with the present invention comprising a first semi-circular ring member 10 formed from metal rod which has its spaced ends shaped into hooks 12 lying in a horizontal plane. A substantially similar semi-circular ring member 14 is connected to the ring member 10 by means of end hooks 16 lying in vertical planes and engaging the hooks 12. There is thus provided a circular ring support which is diametrically hinged. The hooks are so curved that they bind to prevent the ring member 14 from dropping substantially below the plane of ring member 10, as viewed in FIG. 2.

At substantially the central part of the ring member 10 is pivotally mounted a combination latch-handle 18. It, too, is formed from a rod substantially similar to that used for the ring members and is bent at one end into a closed loop 20 engaging the ring member 10. The latch-handle 18 includes a straight portion 22 which extends outwardly from the loop 20 and terminates in a recurved U-shaped latch 24. From latch 24, the latch-handle 18 extends outwardly in a straight portion 26 substantially 90° to portion 22 and terminates in a downwardly curved handle 28. The end of the handle 28 is covered by a protective plastic tip 30. The entire latch-handle 18 is rotatable about the ring member 10 but is prevented from circumferentially sliding therealong by means of a pair of spaced balls, or stops, 32 welded to the ring member member 10 as shown in FIG. 3.

The ring members 10, 14 support the mouth of a flexible bag 34 which may be of any suitable material but, conventionally, is cloth or plastic. It may be supported upon the ring members by any of a number of conventional means. In the illustrated embodiment, the bag is of plastic and has molded around its mouth a number of plastic fasteners 36 of the type having U-shaped jaws locked by means of a hole and stud 38. It will now be apparent from FIGS. 1 and 2 that the circular ring, when hinged outwardly, will maintain the bag in an open condition.

The combined latch-handle 18 is constructed in such a fashion that it will hook over the open door D of a laundry appliance A, such as a washer or dryer, as seen in FIG. 4. In this position, it may be very readily filled or emptied. In order to carry the bag, the ring members are hinged toward one another and the latch-handle 18 on the ring member 10 is pivoted to encircle the opposite ring member 14 and the latch 24 is engaged as shown in FIG. 5. In this configuration, the handle 28 serves as a convenient means for carrying the bag.

It is believed that the many advantages of this invention will now be apparent to those skilled in the art. It will be understood that a number of variations and modifications may be made in this invention without departing from its spirit and scope. For example, the ring need not be circular but may be elliptical, rectangular, or of some other non-circular shape. Accordingly, the foregoing description is to be construed as illustrative only, rather than limiting. This invention is limited only by the scope of the following claims.

What is claimed is:

1. A support for a flexible bag which comprises: a first partial ring member having diametrically spaced ends; a second partial ring member having diametrically spaced ends; means for hingedly interconnecting the ends of said first partial ring member with the ends of said second partial ring member whereby said members are movable from an open, closed ring, configuration to a collapsed, substantially side-by-side configuration; and an elongated member pivotally mounted on said first partial ring member including a curved latch portion engageable with said second partial ring member when in said collapsed configuration.

2. The support of claim 1 wherein said elongated member extends beyond said latch portion and forms a supporting hook for hanging the open support from an external surface.

3. The support of claim 2 wherein said elongated member forms a carrying handle when said latch portion is engaged with said second partial ring member.

4. The support of claim 3 wherein said interconnecting means comprises: first hooks formed in the ends of said first ring member; and second hooks formed in the ends of said second ring member engaging said first hooks.

* * * * *